United States Patent [19]

Johansson et al.

[11] Patent Number: 4,743,482

[45] Date of Patent: May 10, 1988

[54] PROTECTIVE FLAP FOR THE SEAM IN NEEDLE-FELTS FOR INDUSTRIAL USE

[76] Inventors: Jörgen Johansson, Skogsvägen 43; Göran Nohlgren, Blåbärsvägen 21; Erik Nyholm, Skogsvägen, all of Högsjö, Sweden

[21] Appl. No.: 916,367

[22] Filed: Oct. 7, 1986

[30] Foreign Application Priority Data

Oct. 11, 1985 [SE] Sweden ..... 8504734

[51] Int. Cl.[4] ..... B32B 3/00

[52] U.S. Cl. ..... 428/57; 428/61; 428/113; 428/234

[58] Field of Search ..... 428/57, 61, 234, 113

[56] References Cited

U.S. PATENT DOCUMENTS 4,427,734 1/1984 Johnson ..... 428/234

4,500,588 2/1985 Lundström ..... 428/234

*Primary Examiner*—Marion C. McCamish

*Attorney, Agent, or Firm*—Holman & Stern

[57] ABSTRACT

Drying felts provided with a seam in order to facilitate mounting in a paper machine and press felts with such a seam in order to prevent the paper web from being marked by the seam have a wadding flap covering the seam as a continuation of the wadding layer which is fastened to the felt. The wadding flap is worn in different ways when the felt is used in a paper machine and its firmness limits the effective lifetime of the felt and marking in the web occurs due to the wearing of the wadding flap and in order to decrease this wear and to obtain a better felt and a safer production of paper, the protective flap includes at least one layer (6) of wadding having the fibers, yarns or filaments thereof mainly oriented longitudinally in the moving direction of the felt in the machine.

7 Claims, 1 Drawing Sheet

PROTECTIVE FLAP FOR THE SEAM IN NEEDLE-FELTS FOR INDUSTRIAL USE

BACKGROUND OF THE INVENTION

1. Field of the Invention

This invention concerns a protective flap in one or several layers, the uppermost layer being of wadding, which flap covers the releasable seam in needle-felts to be used in machines, as press felts, drying felts, conveyor belts or felts.

2. Description of the Prior Art

Endless felts are used in paper machines in order to convey and support the wet and weak web through the presses and the press section. Felts are also used in the drying section—specifically in marking sensitive positions—in order to convey the web through the drying section, whereby the web is pressed by the felt against heated cylinders.. One of the most important requirements of the felts is that they do not give impressions on the wet web. Such felts have therefore earlier been furnished endless even if this has made it more difficult to mount them in the paper machine. Drying felts have for many years been provided with a seam in order to facilitate the mounting in the paper machine and during the last three years also the press felts have been provided with such a seam. In order to prevent that the paper web is marked by the seam, the seam is covered by a wadding flap, which is a continuation of the wadding layer which is fastened to the felt. The wadding flap is worn in different ways when the felt is used in the paper machine and its firmness will therefore decide the limit for the effective lifetime of the felt and marking in the web will occur due to the wearing of the wadding flap.

Felts which are provided with the above-mentioned seams are so called needle-felts which have a substrate on which a fibrous web, a layer of wadding is fastened. The layer of wadding is usually produced from carded fibrous web, which is placed transversely by an operating means with a breadth, which is in accordance with that of the substrate. The wadding layer is fastened to the substrate by several needles having downwardly directed hooks which penetrate the wadding layer and the substrate so that the fibers of the wadding layer are drawn downwardly between the yarns of the substrate and are fastened.

By this way of covering the substrate by wadding, the fibers of the wadding layer and of the so formed wadding flap over the seam are given a direction, which mainly is transverse to the longitudinal direction of the felts or the moving direction in the machines.

In the wadding flap where the fibers are not needled into the substrate but only penetrated so that the fibers are wound around and tied to each other, the strength in the operating direction will be very low. Fibers very often become loose by strains in the paper machine and the wadding flap can after a certain time fail to fulfil its function as a cover over the seam for preventing marking of the web.

The connection between the wadding flap, the paper machine and the web will be discussed hereinbelow.

A bad or worn out wadding flap in the press section will result in: a risk of marking, breakage of the web, disturbing of the operation of the press, disturbing of the vacuum system and the fiber passage. The elements in the press section which are wearing on the wadding flap are: suction boxes, HT-strips, press cylinders and guiding rollers. A wadding flap which is bad or worn out in the drying section will result in: risk of marking, breakage of the web and air leakage at so called ejector blowing boxes.

Matters which have influence on the strength of the wadding flap in the drying section are: wear of the cylinders and the guiding rollers, chemical degradation and hydrolysis and air blowing for cleaning.

BRIEF SUMMARY OF THE INVENTION

The object of the invention is to provide a protective flap, which is so formed that the wear on it is decreased, in order to obtain a better felt and a safer production of paper. The invention is characterized in that the protective flap includes at least one layer, the fibers, yarns or filaments of which are mainly oriented longitudinally in the moving direction of the felt in the machine.

BRIEF DESCRIPTION OF THE DRAWINGS

An embodiment of the invention will now be described in detail with reference to the accompanying drawings wherein.

DETAILED DESCRIPTION

Figure 1:
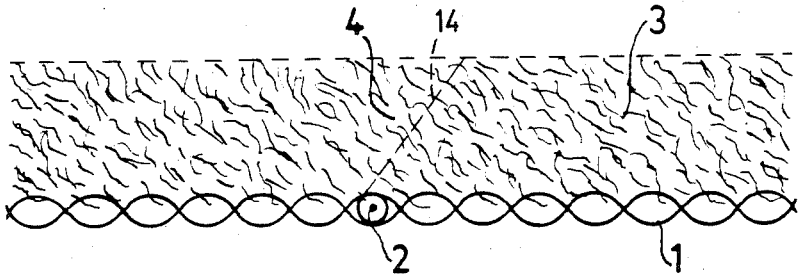
FIG.1 PRIOR ART
FIG. 1 is a schematic longitudinal view of a known felt having layers of wadding and a protective flap.

The felt according to FIG. 1 includes a substrate 1, which has a transversal seam 2, which consists of usual locking loops and locking thread. The layer 3 of wadding having transversal fibers is needled to the upper side of the substrate. The so called protective flap 4 is placed in the area above the seam and to the left of broken line 14 denoting the cut which forms the flap 4.

Figure 2:
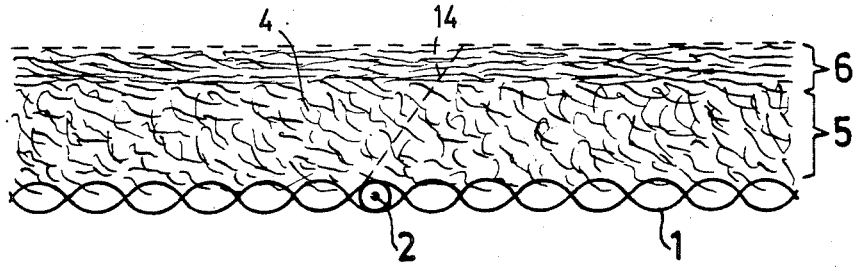
FIG. 2 is a v similar to FIG. 1 of a felt according to the invention.

FIG. 2 shows an embodiment of the invention, whereby the felt includes substrate 1 and the seam 2. A layer 5 of wadding having transversal fibers is placed upon the substrate. A layer 6 of wadding having longitudinal fibers mainly oriented longitudinally in the direction of movement of the felt is placed upon the layer 5. The layers themselves may include several layers. The layer 6 having longitudinal fibers does not need to pass around the entire felt but it is necessary that the layer is placed within the area closest to the seam 2 i.e., layer 6 is provided at least in the area of the flap.

Figure 3:
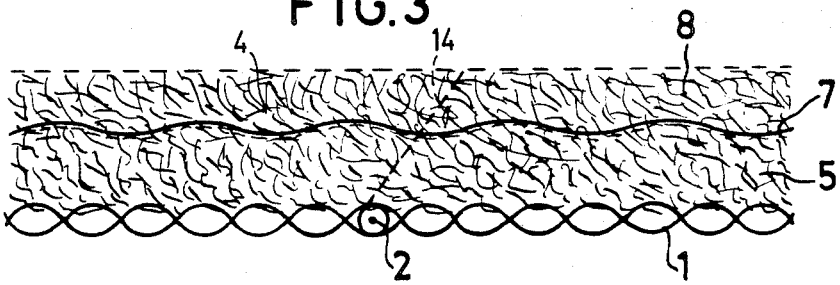
FIG. 3 is a view similar to FIG. 2 showing a second embodiment of the invention n.

A modified emodiment is shown in FIG. 3. On the substrate 1 there is the layer 5 of wadding having transversal fibers. A loose woven fabric "scrim" 7, or a non-woven fabric (e.g. "spun-bond"), is placed on layer 5. The woven fabric or the non-woven fabric 7 has the main part of the fiber material oriented longitudinally in the longitudinal direction of movement of the felt. A further layer 8 of wadding having its fibers oriented in the transversal direction, or in longitudinal direction is then placed on the woven fabric 7.

It should be noted that alternatively the fibers in the layer having the fibers oriented longitudinally moving in the direction may partly or completely be exchanged with other fibers than those which are included in wadding. The exchanged fibers may be stronger or have a better chemical or heat resistance. Fibers having greater length may also be used and also, e.g., multifilament fibers may be used.

Figure 4:
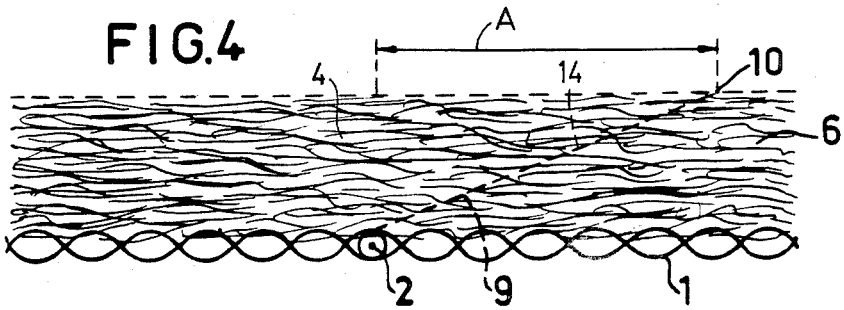
FIG. 4 is a schematic view similar to FIG. 2 of the protective flap formed in order to be able to fasten by needling.

By using longitudinal fibers in order to reinforce at least one of the layers of wadding above the seam, a further possibility is achieved to improve the seam with a flap of wadding. The felt is normally produced by the layer of wadding being needled to the substrate 1, the ends of which are joined with a locked seam. The flap is cut after being needled in the manner shown in FIG. 4. Thus, an oblique cut is made in the direction to the seam along the dashed line 9. When there is a reinforced upper layer having longitudinal fibers it is possible to disengage this from the underlaying layers at a point 10, which lies a certain distance shown by line A after the seam when seen in the moving direction of the web, which is to the left as shown in FIG. 4. The disengaged flap of wadding has sufficient strength so that the structure is maintained when the felt is being mounted in the paper machine. After the felt has been mounted in the machine and the seam 2 has been locked, the felt is placed in the right position over the seam and is fastened on the same place as it was disengaged by needling down into the felt with a portable needling machine having a certain amount of needles. There is a smaller risk for damages and wear on this needled flap than when the flap is free.

The invention is not limited to needle felts in paper machines, but can be adopted for needle felts which have lockable seams and are used as endless, e.g. as in conveyor belts and felts.

We claim:

1. In a press felt for use on a papermaking machine, the press felt having a substrate, a releasable seam extending substantially transversely to the direction of movement of the press felt on the machine, a layer of wadding on the substrate, and a disengageable protective flap in the wadding covering the seam, the improvement wherein the protective flap comprises:

at least one layer of longitudinal fibers wherein said fibers extend substantially in the direction of movement of the felt and overlie the seam.

2. The improvement in a protective flap as claimed in claim 1 wherein:

said at least one layer of longitudinal fibers comprises a wadding.

3. The improvement in a protective flap as claimed in claim 1 wherein:

said at least one layer of longitudinal fibers comprises an outer layer on the layer of wadding.

4. The improvement in a protective flap as claimed in claim 1 wherein:

said wadding comprises at least two layers of wadding; and said at least one layer of longitudinal fibers comprises a fabric interposed between said at least two layers of wadding.

5. The improvement in a protective flap as claimed in claim 4 wherein:

said fabric comprises a woven fabric having longitudinal yarns extending longitudinally in said direction of movement.

6. The improvement in a protective flap as claimed in claim 4 wherein:

said fabric comprises a non-woven fabric having longitudinal yarns extending longitudinally in said direction of movement.

7. The improvement in a protective flap as claimed in claim 1 wherein:

said at least one layer of longitudinal fibers comprises the wadding;

said protective flap has a joining edge extending in a plane transversely to said direction of movement and obliquely from substantially the seam in the direction opposite to said direction of movement; and said protective flap is fixed to the press felt by needling.

* * * * *